US008186457B2

(12) United States Patent
Boyle

(10) Patent No.: US 8,186,457 B2
(45) Date of Patent: May 29, 2012

(54) OFFSHORE CASING DRILLING METHOD

(75) Inventor: John Boyle, The Woodlands, TX (US)

(73) Assignee: Tesco Corporation, Houston, TX (US)

( * ) Notice: Subject to any disclaimer, the term of this patent is extended or adjusted under 35 U.S.C. 154(b) by 308 days.

(21) Appl. No.: 12/561,416

(22) Filed: Sep. 17, 2009

(65) Prior Publication Data

US 2011/0061939 A1 Mar. 17, 2011

(51) Int. Cl.
*E21B 7/20* (2006.01)

(52) U.S. Cl. ..... 175/57; 175/171; 166/85.4; 166/285

(58) Field of Classification Search ..... 175/171, 175/57; 166/85.4, 285
See application file for complete search history.

(56) References Cited

U.S. PATENT DOCUMENTS

| | | | |
|---|---|---|---|
| 3,163,238 | A | 12/1964 | Malott |
| 5,074,366 | A | 12/1991 | Karlsson et al. |
| 5,425,423 | A | 6/1995 | Dobson et al. |
| 5,957,225 | A | 9/1999 | Sinor |
| 6,095,261 | A | 8/2000 | Trevino, Jr. |
| 6,138,774 | A | 10/2000 | Bourgoyne, Jr. et al. |
| 6,412,574 | B1 | 7/2002 | Wardley et al. |
| 6,543,552 | B1 | 4/2003 | Metcalfe et al. |
| 6,742,606 | B2 | 6/2004 | Metcalfe et al. |
| 6,854,533 | B2 | 2/2005 | Galloway et al. |
| 6,857,487 | B2 | 2/2005 | Galloway et al. |
| 6,899,186 | B2 | 5/2005 | Galloway et al. |
| 7,013,997 | B2 | 3/2006 | Vail, III |
| 7,036,610 | B1 | 5/2006 | Vail, III |
| 7,040,420 | B2 | 5/2006 | Vail, III |
| 7,044,241 | B2 * | 5/2006 | Angman ..... 175/61 |
| 7,048,050 | B2 | 5/2006 | Vail, III et al. |
| 7,083,005 | B2 | 8/2006 | Galloway et al. |
| 7,093,675 | B2 | 8/2006 | Pia |
| 7,100,710 | B2 | 9/2006 | Vail, III |
| 7,108,080 | B2 | 9/2006 | Tessari et al. |
| 7,108,084 | B2 | 9/2006 | Vail, III |
| 7,117,957 | B2 | 10/2006 | Metcalfe et al. |

(Continued)

FOREIGN PATENT DOCUMENTS

| | | | |
|---|---|---|---|
| CA | 2538196 | | 8/2006 |
| WO | 0194738 | A1 | 12/2001 |
| WO | 2006012186 | A1 | 2/2006 |
| WO | WO2007/011906 | A1 | 1/2007 |

OTHER PUBLICATIONS

Warren et al., "Casing Drilling with directional steering in the US Gulf of Mexico," Jan. 2001, Offshore Magazine pp. 50, 52, 53.*

(Continued)

*Primary Examiner* — Nicole Coy
(74) *Attorney, Agent, or Firm* — Bracewell & Giuliani LLP

(57) ABSTRACT

A method of casing drilling a portion of an offshore well includes running a casing string with a drill bit assembly attached to it into a previously drilled portion of the well. Before the drill bit assembly reaches bottom, the operator attaches drill pipe to the casing string and lowers the casing string on the drill pipe. When the drill bit is at bottom, an upper end of the casing string should be below the blowout preventer. The operator then performs casing drilling by rotating the drill pipe. When at a desired depth for the casing string, the operator pulls the drill pipe from the well and lifts the casing string up until its upper end is at the rig floor. The operator then runs the casing string back into the well but using casing in this instance. The operator then cements the casing string.

19 Claims, 4 Drawing Sheets

U.S. PATENT DOCUMENTS

| | | | | |
|---|---|---|---|---|
| 7,147,068 | B2 | 12/2006 | Vail, III | |
| 7,165,634 | B2 | 1/2007 | Vail, III | |
| 7,228,901 | B2 | 6/2007 | Vail, III | |
| 7,234,542 | B2 | 6/2007 | Vail, III | |
| 7,311,148 | B2 | 12/2007 | Giroux et al. | |
| 7,334,650 | B2 | 2/2008 | Giroux et al. | |
| 7,475,742 | B2 * | 1/2009 | Angman et al. | 175/61 |
| 7,938,201 | B2 * | 5/2011 | Giroux et al. | 175/171 |
| 2001/0017210 | A1 | 8/2001 | Howlett | |
| 2005/0103525 | A1 | 5/2005 | Sangesland | |
| 2006/0196695 | A1 | 9/2006 | Giroux et al. | |
| 2007/0007014 | A1 | 1/2007 | Sessions et al. | |
| 2007/0107911 | A1 | 5/2007 | Miller et al. | |
| 2007/0175665 | A1 | 8/2007 | Tessari et al. | |
| 2007/0267221 | A1 | 11/2007 | Giroux et al. | |
| 2009/0090508 | A1 * | 4/2009 | Brouse | 166/289 |
| 2009/0101345 | A1 | 4/2009 | Moffitt et al. | |

OTHER PUBLICATIONS

Weatherford "R Running Tool with Hydraulically Released Mechanical Lock", 2006, pp. 1-2.
Drilling Contractor "Liner Drilling Technology Being Prepared for Offshore", Jan./Feb. 2004, pp. 14-15.
Dril-Quip LS-15 Liner Hanger System, Sales Manual, pp. 5-7.
TIW "Liner Equipment" HLX Liner-Top Packer, pp. 5, 9-11, 18-19.
Dril-Quip "LS-15 Liner Hanger System", pp. 1-2, 4 and 6.
U.S. Appl. No. 12/275,396, filed Nov. 21, 2008.
U.S. Appl. No. 12/238,191, filed Sep. 25, 2008.
World Oil/Oct. 1999—Drilling Technology "Casing-While-Drilling: The Next Step Change in Well Construction", pp. 34-36 and 38-40.
Drilling Liner Technology for Depleted Reservoir, C. Vogt, SPE and F. Makohl, SPE, Baker Hughes INTEQ; P. Suwarno, SPE and B. Quitzau, SPE, Mobil Oil Indonesia—SPE 36827—pp. 127-132.
Simultaneous Drill and Case Technology—Case Histories, Status and Options for Further Development, by Detlef Hahn, Baker Hughes Inteq, Wilhelmus Van Gestel, BP Amoco Norway AS, Norbert Frohlich, Baker Hughes Inteq, Glenn Stewart, Baker Hughes Inteq—SPE International, IADC/SPE 59126, Feb. 23-25, 2000, pp. 1-9.
U.S. Appl. No. 12/347,443, filed Dec. 31, 2008.
Rotary Steerable Drilling with Liner—during 2007 or later based on the text—Randi Elisabeth Hugdahl, Leader, TNE RD RCT DWPT—pp. 3-5.
International Search Report dated Jan. 6, 2011.

* cited by examiner

OFFSHORE CASING DRILLING METHOD

FIELD OF THE INVENTION

This invention relates in general to offshore well drilling operations, and in particular to performing casing drilling in offshore wells.

BACKGROUND OF THE INVENTION

Offshore drilling normally takes place with either a floating drilling rig, a fixed platform, or a jackup drilling rig. A riser or some other type of conduit will extend from the seafloor to the drilling rig. The riser will have a blowout preventer (BOP) that is able to close around a drill string as well as to sever it. The BOP serves to prevent a dangerous blowout of the well in the event an unexpectedly high pressure earth formation is drilled into and overcomes the hydrostatic pressure of the drilling fluid. The BOP may be located subsea near the seafloor or it may be located above sea level at the drilling rig.

Normally the operator drills the well with a string of drill pipe. Drill pipe comprises thick wall joints of pipe that are secured together to make up a string. The drill pipe is constructed so to allow the operator to frequently unscrew and screw the joints together. When the operator reaches a depth that he wishes to run casing, he pulls out the drill pipe, then runs back into the well with the string of casing. The operator cements the casing in the well. The casing may extend to a subsea wellhead assembly or it may extend to a wellhead assembly above sea level at the rig.

In some geographic areas, difficult zones are encountered while drilling the well. For example, a difficult zone may comprise a low pressure, porous zone located below a much higher pressure earth formation or zone. Normally the operator will have the well loaded with drilling mud that has a weight selected so as to be able to prevent the pressure within the higher pressure earth formation from overcoming the weight of drilling fluid and causing the earth formation to flow into the well. If the weight of drilling mud is too low, a blowout might occur. When drilling from a higher pressure zone into a lower pressure zone, the weight of the drilling mud might be too heavy for the lower pressure zone. If too heavy, drilling fluid will flow into the lower pressure zone, resulting in a loss of expensive drilling fluid. Also, circulation may be lost, preventing the drilling fluid from circulating to and from the drill rig. In addition, if the lower pressure zone is intended to be a production zone, the encroaching drilling fluid could irreparably damage the ability of the production zone to produce hydrocarbon.

Operators overcome these problems through experience in estimating where the difficult zones lie. An operator may choose to stop drilling just above the difficult zone, run a string of casing and cement it in the well. The operator then would be able to utilize lesser weight drilling fluid for drilling through the lower pressure zone.

In another technique that has been proposed but is not in widespread use, the operator would run and install casing just above the difficult zone as in the first method. The operator would then lower a liner string with a drill bit on the lower end into the well. The upper end of the liner string would be secured to a string of drill pipe. The operator rotates the drill pipe and the liner string to drill through the difficult zone. Afterward, the operator cements the liner in place. The liner is made up of the same type of pipe as casing, but it does not extend all the way back to the wellhead. Instead, it will be hung off at the lower end of the previously installed string of casing. The term "casing string" on the other hand normally refers to pipe that is cemented in the well and extends all the way back to the wellhead.

While liner drilling as described is feasible, an operator may prefer to have casing extending all the way back to the wellhead. Casing drilling is a known technique that is principally used on land wells. The operator rotates the casing string with a casing gripper mounted to a top drive at the drill rig. A drill bit assembly, which may be retrievable or not, is located at the lower end of the casing string. While this technique works well on land, there are regulations for offshore drilling that restricts this technique. In some geographic areas, regulations state that the blowout preventer for an offshore drilling rig has to be capable of completely severing any drill string passing through it while drilling is taking place. In an emergency, the operator has to be able to close the upper end of the well at the BOP, even if that includes severing the drill string in the well. BOPs used offshore are capable of severing conventional drill pipe. However, BOPs used on offshore rigs are typically not capable of severing the casing that would normally be run. Consequently, casing drilling with the casing being rotated by casing gripper and top drive to cause the drilling may violate safety regulations in some geographic areas.

SUMMARY OF THE INVENTION

In this invention, the operator is able to utilize a type of casing drilling for an offshore rig without violating safety regulations. The operator first drills the well to a selected depth using a conventional drill pipe string. This depth may be just above a difficult zone. The operator then retrieves the drill pipe and makes up a string of casing. The operator lowers the string of casing into the well by adding additional joints of casing. When the drill bit assembly on the lower end of the casing string nears bottom, the operator will attach a crossover, then connect a string of drill pipe to the string of casing. Once connected, when the drill bit reaches bottom, the upper end of the casing string will be below the BOP.

The operator then begins drilling by rotating the drill pipe, the casing string and the drill bit assembly. The casing string will move downward and the operator will add additional joints of drill pipe until a desired depth is reached for the casing. During this additional drilling, the length of the casing string does not change. When at the desired depth, the operator lifts the drill pipe and casing string assembly and retrieves the drill pipe. When the upper end of the casing string reaches the drill rig floor, the operator will begin attaching additional joints of casing to lengthen the casing string and lower the casing string back into the well. When the drill bit reaches the bottom of the well, the upper end of the casing string will be at the rig floor. While running the casing string back to the bottom, the operator may need to ream and circulate drilling fluid. The operator can do this with the casing string, including rotating the casing string as it extends through the BOP. However, since the casing string is only reaming a previously drilled section of the well bore, reaming is not a violation of the safety regulations.

After reaching the total depth, the operator retrieves the drill bit assembly from the casing string in one or more methods. That can be done by lowering a string of drill pipe through the casing, running a wireline into the casing, or by pumping the drill bit assembly up through the casing string using reverse circulation. The operator then is free to cement the string of casing in the well. At least one plug will be typically pumped down the casing string to latch onto a lower portion of the casing string and prevent backflow of cement from the casing annulus back into the casing string.

DETAILED DESCRIPTION OF THE INVENTION

Figure 1:
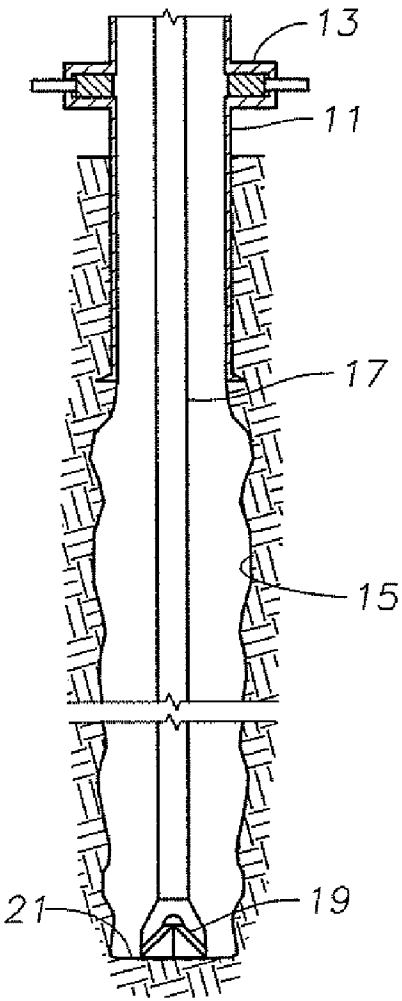
FIG. 1 is a schematic view of a first step in drilling a well in accordance with this invention.

Referring to FIG. 1, an outer casing string 11 is shown cemented in an offshore well. Outer casing string 11 is schematically shown connected to a blowout preventer (BOP) 13. BOP 13 could be located subsea, but preferably is located above sea level. Outer casing string 11 could have a lower portion located below the mud line or sea floor and an upper portion that latches into the lower portion at the mud line or sea floor. The upper portion of outer casing string 11 serves as a riser to confine drilling fluid while drilling the well. BOP 13 has a number of elements for closure, including pipe rams, a full closure annular element, and shear rams.

An open hole section 15 of the well is illustrated as being drilled by a string of drill pipe 11 having a drill bit 19 on its lower end. The operator drills open hole section 15 conventionally by rotating drill pipe 17 and drill bit 19. The operator pumps drilling fluid down drill pipe 17, which flows back up open hole section 15 and outer casing string 11 to the drilling rig. Drill pipe 17 comprises conventional drill pipe and drill collars. Drill collars normally have a constant diameter outer wall from one end to the other. Drill pipe typically has upset ends or tool joints that are threaded for connection to other drill pipe members. Drill pipe 17 is not intended to be cemented in the well.

The operator will drill conventionally to a first depth 21, which may be selected as being close to a difficult zone or earth formation. For example, as mentioned above, it could be a low pressure zone located below a higher pressure zone. When reaching first depth 21, the operator retrieves drill pipe 17 and drill bit 19, then makes up a first length of inner casing string 23. Inner casing string 23 comprises conventional easing that is intended to line open hole section 15 and be cemented within the well bore. However, before cementing, the operator intends to drill deeper. Thus, a bottom hole assembly 25 is connected to the lower end of inner casing string 23. Bottom hole assembly 25 is preferably secured by a latch 27 to an interior portion of inner casing string 23 not far from the lower end. Bottom hole assembly 25 has a drill bit assembly on its lower end comprising a conventional drill bit 29 and an underreamer 31. Underreamer 31 has pivotal arms that swing out to circumscribe a diameter greater than the outer diameter of inner casing string 23. Underreamer 31 will thus be able to drill a bore hole greater than drill bit 29, which serves as a pilot bit. Many different designs exist for underreamer 31 including incorporating it with drill bit 29, incorporating it with a the lower end of inner casing string 23 or as a stand alone component secured to drill bit 29. The operator lowers inner casing string 23 by securing additional joints of casing to casing string 23 until drill bit 29 is near first depth 21. While making up inner casing string 23, inner casing string 23 will pass through BOP 13, but since no drilling is occurring, safety regulations are met. While making up casing string 23, the operator could rotate casing string 23 and pump drilling fluid through it to ream open hole section 15, if needed. Even though casing string 23 would be passing through BOP 13, safety regulations are still met because reaming an existing open hole section 15 is not considered to be drilling.

Figure 3:
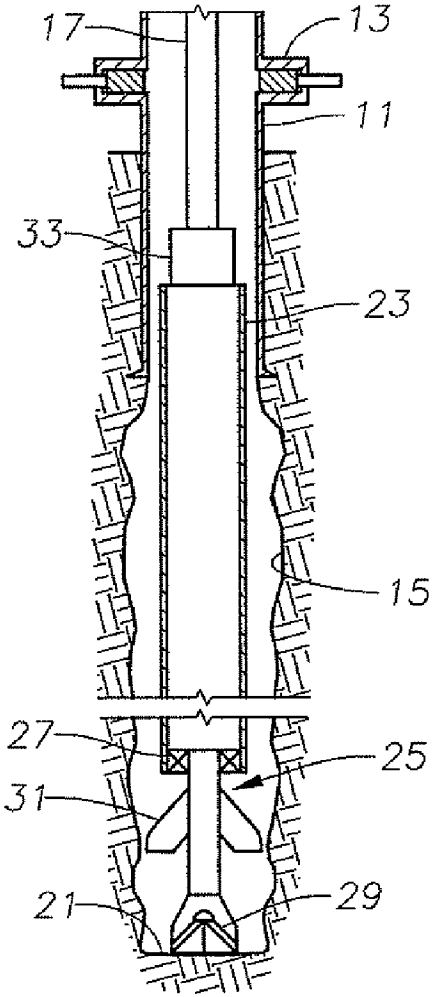
FIG. 3 is a schematic view of a third step in drilling a well in accordance with this invention.
Figure 2:
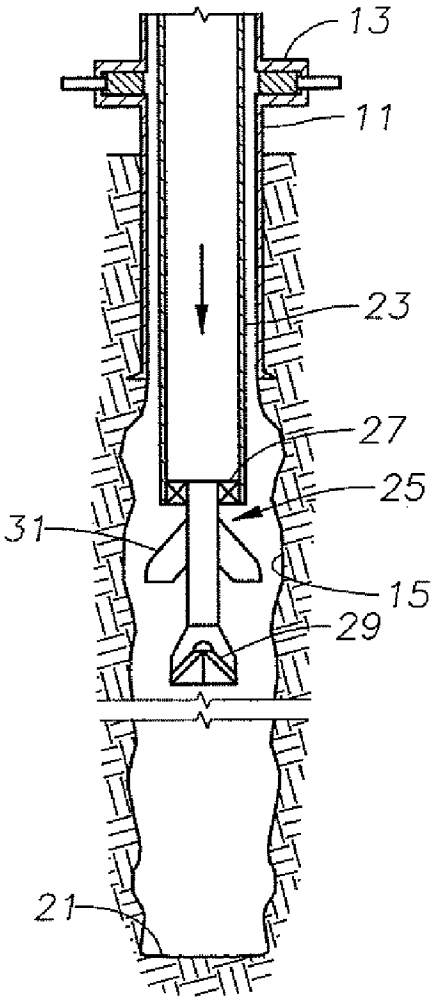
FIG. 2 is a schematic view of a second step of drilling a well in accordance with this invention.

Referring to FIG. 3, when drill bit 29 is located near first depth 21, the operator secures an adapter or crossover 33 to the upper end of inner casing string 23. The operator connects drill pipe 17 to adapter 33. Drill pipe 17 may be the same drill pipe as utilized in the first step illustrated in FIG. 1. At this point, the total length of inner casing string 23, including bottom hole assembly 25, is less than the distance from first depth 21 to BOP 13. This places the upper end of inner casing string 23 below BOP 13.

Bottom hole assembly 25 may include a drill or mud motor that operates in response to drilling fluid pressure to rotate drill bit 29 independently of inner casing string 23 and drill pipe 17. Bottom hole assembly 25 may include other tools, such as logging, steering and directional drilling instruments. Although drill pipe 17 is shown attached to the upper end of inner casing string 23, alternately, drill pipe 17 could extend through the length of inner casing string 23 and connect directly to bottom hole assembly 25.

Figure 4:
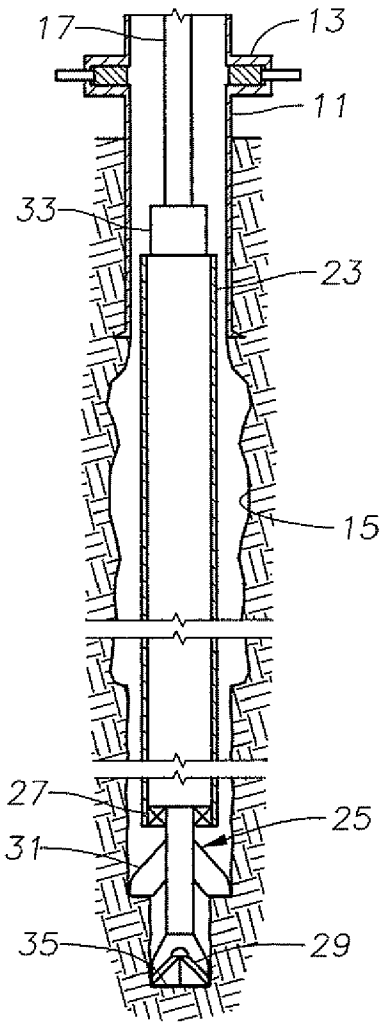
FIG. 4 is a schematic view of a fourth step of drilling a well in accordance with this invention.

The operator then begins drilling the well to deepen it as illustrated in FIG. 4. While doing so, typically the operator will rotate drill pipe 17, which rotates inner casing string 23, which in turn rotates drill bit 29 and underreamer 31. During this drilling, drill pipe 17 will be extending through BOP 13, thus meeting safety regulations. In the event of a blowout, the operator could sever drill pipe 17 with BOP 13. While drilling, the operator will pump drilling fluid down drill pipe 17, which flows down inner casing string 23, out drill bit 29 and back up the annulus surrounding inner casing string 23.

Figure 5:
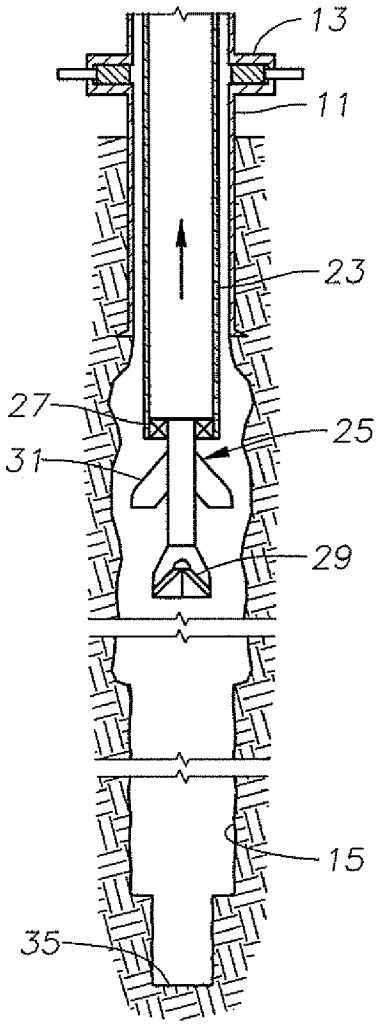
FIG. 5 is a schematic view of a fifth step of drilling a well in accordance with this invention.

The operator continues drilling as illustrated in FIG. 4, by adding additional joints of drill pipe 17 as the well deepens. The first length of casing string 23 does not change during drilling. When the operator reaches a desired second depth 35, he will pull drill pipe 17 from the well as illustrated in FIG. 5. The second depth 35 is intended to be the depth at which inner casing string 23 is cemented. This depth could be a total depth of the well, or it could be an immediate depth. As shown in FIG. 5, as the operator removes drill pipe 17, inner casing string 23 and bottom hole assembly 25 will move upward in open hole section 15. When all of the drill pipe 17 has been removed, the upper end of inner casing string 23 will be at the drilling rig floor. The operator then begins securing more sections of casing to inner casing string 23 to lower inner casing string 23 back into the well and increase the length of inner casing string 23 to a second length.

Figure 6:
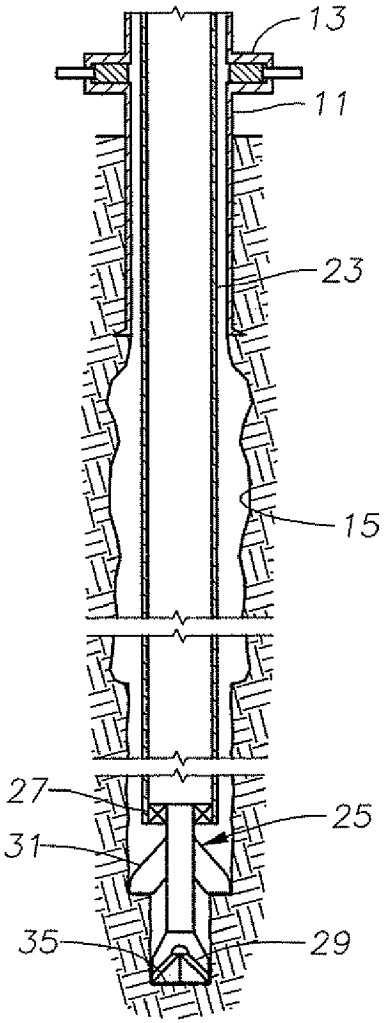
FIG. 6 is a schematic view of a sixth step in drilling a well in accordance with this invention.

Bottom hole assembly 25 could be retrieved before lowering inner casing 23 back into the well, but preferably it will remain in place. If part of open hole 15 has bridged off, having bottom hole assembly 25 in place will allow the operator to ream open hole 15. The operator reams by rotating underreamer 31. That operation can be performed by a drill motor or by rotating inner string 23, which always will have its upper end at the rig floor while being run back in. The operator can also reciprocate inner case string 23 up and down while running back in. The operator can also pump drilling fluid through inner casing string 23 and back up the annulus. FIG. 6 illustrates bottom hole assembly 25 back on second depth 35, but the operator need not run bottom hole assembly 25 all the way back to second depth 35.

Figure 7:
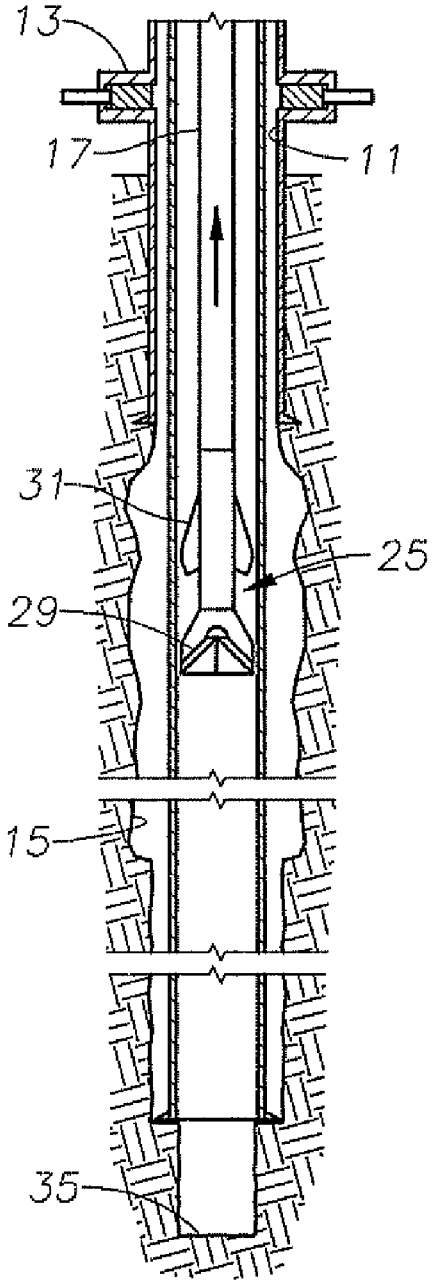
FIG. 7 is a schematic view of a seventh step in drilling a well in accordance with this invention.
Figure 8:
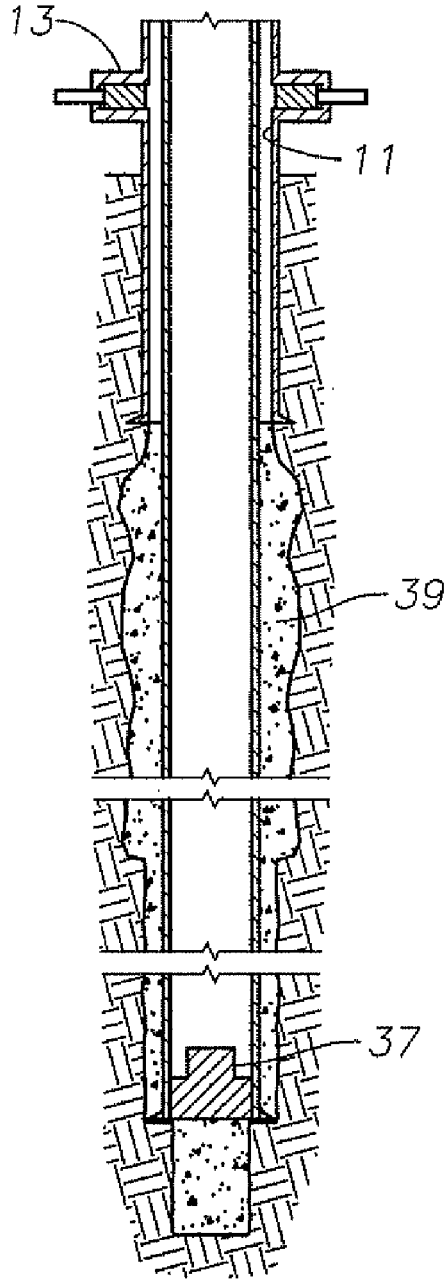
FIG. 8 is a schematic view of an eighth step of drilling a well in accordance with this invention.

Referring to FIG. 7, if bottom hole assembly 25 is a retrievable type, which is preferred, it will then be retrieved while the full second length of inner casing string 23 remains suspended in the well. There are three main ways to retrieve bottom hole assembly 25. In one technique, a retrieval tool is secured to the lower end of drill pipe 17, then drill pipe 17 is lowered through inner casing string 23 into engagement with the upper end of bottom hole assembly 25. The operator engages bottom hole assembly 25 and pulls it to the surface, as illustrated in FIG. 8. The arms of underreamer 31 will collapse as they pass into the inner diameter of inner casing string 23. In another technique, a retrieval tool on a wire line is lowered down into engagement with bottom hole assembly 25. In a third method, the operator creates reverse circulation, which causes drilling fluid in the annulus around casing string 23 to flow down and up against bottom hole assembly 25 to push it up inner casing string 23.

Referring to FIG. 8, after retrieving bottom hole assembly 25, the operator will cement inner casing string 23 by pumping cement 39 down inner casing string 23. Cement 39 flows up the annulus around casing string 23 in open hole 15, cementing inner casing string 23 in place. Normally, the operator will at least pump one cement plug 37 down at the upper end of the cement column to wipe the interior of inner casing string 23. Plug 37 latches into the lower portion of inner casing string 23 and prevents any backflow of cement 39 back into the interior of inner casing string 23. Optionally, the operator may pump an initial receptacle down inner casing string 23 before cementing. The initial receptacle could include a float or check valve, if desired. The receptacle or valve, if utilized, could also be installed in other manners, such as with a wire line or by running it in on drill pipe. Normally, prior to cementing, the upper end of inner casing string 23 will be prepared and hung off in a surface wellhead assembly.

Figure 9:
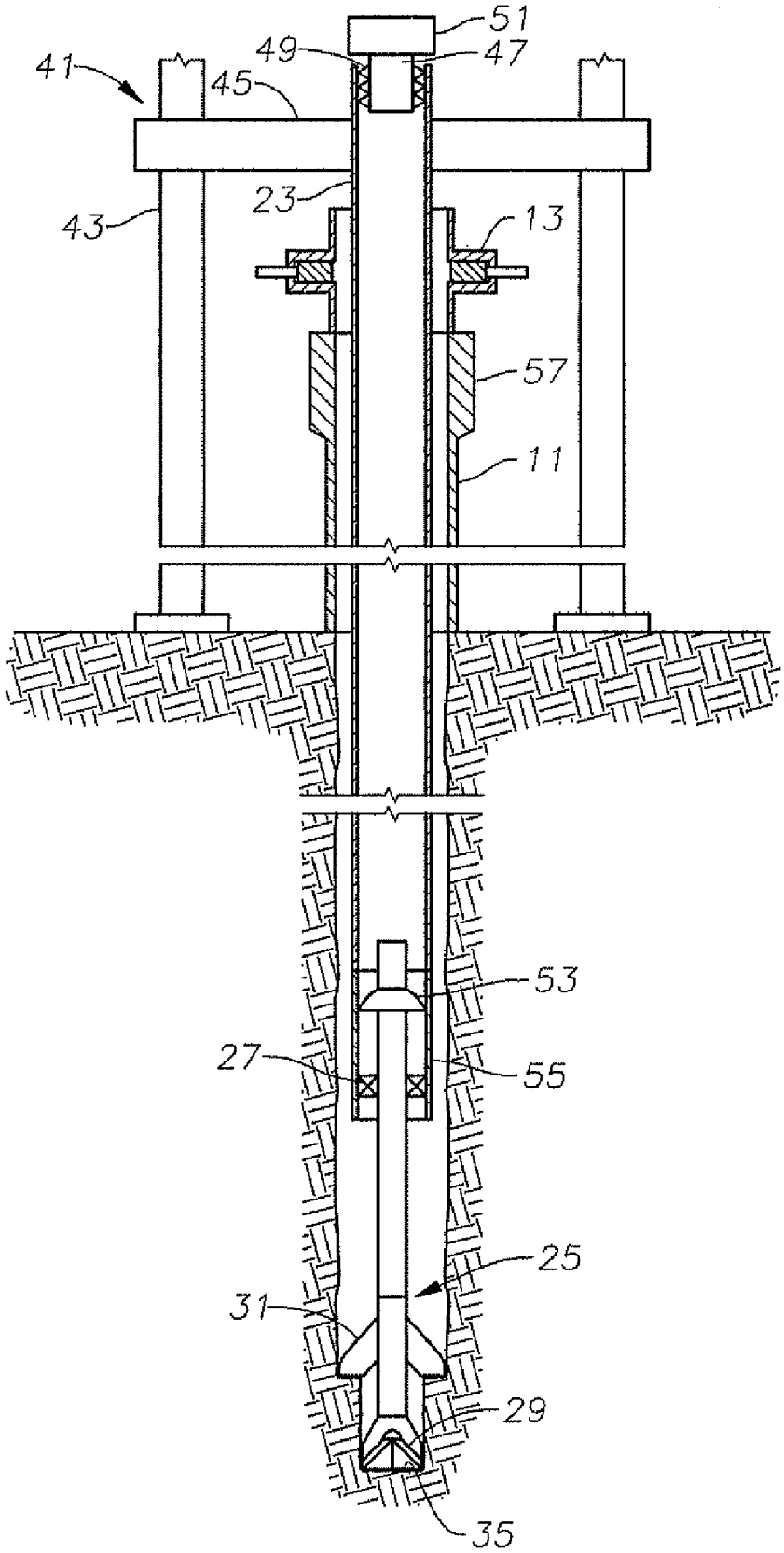
FIG. 9 is an enlarged schematic view of the sixth step and showing additional structure.

FIG. 9 is an enlarged and somewhat more detailed view of FIG. 6. The drilling rig in this example comprises a jackup platform 41. Platform 41 has a plurality of legs 43 that have lower ends that can be lowered into engagement with the sea floor. The leg control mechanism will then lift platform 41 above the sea level. Platform 41 has a rig floor 45 with an opening in alignment with the well. A casing gripper 47 has grippers 49 that will move radially to engage inner casing string 23. Once engaged, casing gripper 47 will support the weight of inner casing string 23. Also, it will impart drilling torque to inner casing string 23. Casing gripper 47 is removably attached to a rotary drive stem of a top drive 51. Top drive 51 moves up and down the derrick (not shown) as well as imparting rotation to casing gripper 47. Top drive 51 is also employed during the conventional drilling step in FIG. 1. In that instance, casing gripper 47 is removed from top drive 51 and set aside. Drill pipe 17 will attach to top drive 51.

FIG. 9 shows that bottom hole assembly 25 preferably has one or more seals 53 that seal against the inner diameter of casing string 23, which includes a profile sub 55. Profile sub 55 is connected into inner casing string 23 near or at the bottom. It has recesses within it for receiving latch 27. Latch 27 will axially lock bottom hole assembly 25 to profile sub 55 as well as impart rotation between inner casing string 23 and bottom hole assembly 25.

A wellhead 57 is schematically illustrated as being located at the upper end of outer casing string 11 below BOP 13. Upon completion, inner casing string 23 will be connected by slips or a casing hanger to wellhead 57.

The method described allows the operator to drill with casing while passing through a difficult zone but still meeting safety regulations because the casing string will be supported by a string of drill pipe during drilling. The casing string can be cemented into the well and extend all the way to the wellhead, unlike a liner.

While the invention has been shown in only one of its forms, it should be apparent to those skilled in the yard that it is not so limited but is susceptible to various changes without departing from the scope of the invention.

The invention claimed is:

1. A method of drilling a well with a drilling rig having a blowout preventer (BOP), comprising:

(a) drilling the well to a selected first depth using drill pipe;

(b) then running a first length of casing into the well with a drill bit assembly attached, the first length being less than a distance from the first depth to the BOP;

(c) attaching drill pipe to the first length of casing and while the drill pipe extends through the BOP, drilling the well from the first depth to a second depth with the drill bit assembly attached to the first length of casing;

(d) when at a selected second depth, pulling the drill pipe from the well and adding more joints of casing to the first length of casing to increase the first length to a second length of casing with a lower end of the second length of casing approximately at the second depth and an upper end of the second length of casing at the rig; and (e) cementing the second length of casing in the well.

2. The method according to claim 1, further comprising retrieving the drill bit assembly through the second length of casing after step (d).

3. The method according to claim 1, wherein step (c) comprises attaching a lower end of the drill pipe to an upper end of the first length of casing.

4. The method according to claim 1, wherein step (e) comprises pumping cement down the second length of casing and up an annulus surrounding the second length of casing, followed by pumping down a cement plug from the rig to prevent back flow of the cement into the second length of casing.

5. The method according to claim 1, further comprising reaming at least part of the well by rotating the drill bit assembly in step (d).

6. The method according to claim 1, wherein no drilling with the drill bit assembly takes place while any joint of casing of the first length of casing or the second length of casing is extending through the BOP.

7. The method according to claim 1, wherein the drilling rig is an offshore platform and the BOP is located above a level of the sea.

8. The method according to claim 1, wherein:

drilling the well in step (c) comprises rotating the drill pipe, the first length of casing and the drill bit assembly.

9. The method according to claim 1, wherein step (d) comprises positioning an upper end of the first length of casing at a rig floor of the rig before adding more joints of casing.

10. A method of casing drilling a portion of an offshore well without casing extending through a blowout preventer (BOP) during any portion of the casing drilling, comprising:

(a) running a casing string with a drill bit assembly attached into a previously drilled portion of the well;

(b) before the drill bit assembly reaches bottom, attaching drill pipe to the casing string and lowering the casing string on the drill pipe until an upper end of the casing string is below the BOP;

(c) then, while the drill pipe is extending through the BOP, rotating the drill pipe, the casing string and the drill bit assembly to deepen the well;

(d) when at a desired depth for the casing string, pulling the drill pipe from the well and lifting the casing string until the upper end of the casing string is at a rig floor of the rig;

(e) then, adding more joints of casing to the casing string to run the casing string back into the well; then (f)cementing the casing string in the well.

11. The method according to claim 10, further comprising retrieving the drill bit assembly before step (f).

12. The method according to claim 10, further comprising retrieving the drill bit assembly from the casing string while the casing string remains in the well after step (e) and before step (f).

13. The method according to claim 10, further comprising during step (e) and while the casing string is extending through the BOP, reaming at least part of the well by rotating the casing string and the drill bit assembly.

14. The method according to claim 10, wherein:

step (f) comprises pumping cement down the casing string and up an annulus surrounding the casing string; and deploying a cement plug into an upper end of the casing string at the rig floor and pumping the cement plug to a lower end of the casing string; and with the cement plug, preventing back flow of cement from the annulus into the casing string.

15. A method of drilling a well with a drilling rig having a blowout preventer (BOP), comprising:

(a) installing at least one outer casing string in the well;

(b) with drill pipe lowered through the outer casing string, drilling the well below the outer casing string to a selected first depth;

(c) then running an inner casing string into the well through the outer casing string with a drill bit assembly attached;

(d) before the drill bit assembly reaches the first depth, attaching drill pipe to the inner casing string and lowering the inner casing string on the drill pipe until the drill bit assembly is at the first depth and an upper end of the inner casing string is below the BOP;

(e) then, rotating the drill pipe, the inner casing string and the drill bit assembly to deepen the well from the first depth to a second depth and adding additional joints of the drill pipe as the well deepens;

(f) when at the second depth, pulling the drill pipe from the well and lifting the inner casing string until the upper end of the inner casing string is at a rig floor of the rig;

(g) then, adding more joints of casing to the inner casing string to lower the inner casing string while the drill bit assembly is still attached, until the drill bit assembly is approximately at the second depth;

(h) then, retrieving the drill bit assembly from the inner casing string while the inner casing string remains in the well; and (i) cementing the inner casing string in the well.

16. The method according to claim 15, wherein step (g) comprises rotating the inner casing string and the drill bit assembly to ream the well on at least one occasion while lowering the inner casing string.

17. The method according to claim 15, wherein the upper end of the inner casing string will be at the rig floor at the conclusion of step (g).

18. The method according to claim 15, wherein step (i) comprises pumping cement down the second length of casing and up an annulus surrounding the second length of casing, followed by a cement plug to prevent back flow of the cement into the second length of casing.

19. The method according to claim 15, wherein no drilling with the drill bit assembly takes place while the inner casing string extends through the BOP.

* * * * *